US009469316B2

(12) United States Patent
Tippey et al.

(10) Patent No.: US 9,469,316 B2
(45) Date of Patent: Oct. 18, 2016

(54) USING WAYSIDE SIGNALS TO OPTIMIZE TRAIN DRIVING UNDER AN OVERARCHING RAILWAY NETWORK SAFETY SYSTEM

(71) Applicant: NEW YORK AIR BRAKE CORPORATION, Watertown, NY (US)

(72) Inventors: Jeffrey S. Tippey, Arlington, TX (US); Sean Adams, Elk Grove, CA (US); Sung-Ho Jee, Leeming (AU); Graham Hausler, Woodlands (AU); Wade Goforth, Carrollton, TX (US)

(73) Assignee: NEW YORK AIR BRAKE CORPORATION, Watertown, NY (US)

( * ) Notice: Subject to any disclaimer, the term of this patent is extended or adjusted under 35 U.S.C. 154(b) by 52 days.

(21) Appl. No.: 14/050,914

(22) Filed: Oct. 10, 2013

(65) Prior Publication Data

US 2015/0102177 A1 Apr. 16, 2015

(51) Int. Cl.

| | |
|---|---|
| ***B61L 3/12*** | (2006.01) |
| ***B61L 15/00*** | (2006.01) |
| ***B61L 27/00*** | (2006.01) |
| ***B61L 3/00*** | (2006.01) |
| ***B61L 25/02*** | (2006.01) |

(52) U.S. Cl.

CPC ..... *B61L 3/125* (2013.01); *B61L 3/006* (2013.01); *B61L 15/0027* (2013.01); *B61L 25/025* (2013.01); *B61L 27/0027* (2013.01); *B61L 27/0038* (2013.01)

(58) Field of Classification Search

CPC ..... B61L 3/00; B61L 3/002; B61L 3/004; B61L 15/00; B61L 15/0018; B61L 15/0027; B61L 15/0072; B61L 25/00; B61L 25/02; B61L 25/021; B61L 2205/02

USPC ..... 246/2 R, 2 E, 3, 4, 108, 122 R–124, 246/167 R, 176, 182 R; 701/19, 20

See application file for complete search history.

(56) References Cited

U.S. PATENT DOCUMENTS

| | | | | |
|---|---|---|---|---|
| 5,978,718 | A * | 11/1999 | Kull | 701/19 |
| 7,317,987 | B2 * | 1/2008 | Nahla | 701/301 |
| 8,214,091 | B2 * | 7/2012 | Kernwein | B61L 25/025 246/122 R |

OTHER PUBLICATIONS

International Search Report Form PCT/ISA/210, International Application No. PCT/US13/64312, pp. 1-2, Dated Mar. 4, 2014.

* cited by examiner

*Primary Examiner* — R. J. McCarry, Jr.

(74) *Attorney, Agent, or Firm* — Bond Schoeneck and King PLLC; David Nocilly

(57) ABSTRACT

Disclosed embodiments provide a system and methodologies that provide an optimized train driving strategy using wayside signaling while conforming to the requirements of a wayside track safety system, e.g., the "Automatic Train Protection" (ATP) System.

15 Claims, 6 Drawing Sheets

USING WAYSIDE SIGNALS TO OPTIMIZE TRAIN DRIVING UNDER AN OVERARCHING RAILWAY NETWORK SAFETY SYSTEM

FIELD

Disclosed embodiments provide a method for improving the ability to enhance safety by providing an optimized train driving strategy using wayside signaling while conforming to the requirements of an "Automatic Train Protection" (ATP) System.

BACKGROUND

Various conventional train protection systems have been developed around the globe with the goal to provide railway technical installations to ensure safe operation in the event of human failure.

Positive Train Control (PTC) refers to conventionally known technology that is designed to prevent train-to-train collisions, overspeed derailments, casualties or injuries to roadway workers operating within their limits of authority as a result of unauthorized incursion by a train as well as prevent train movements through a switch left in the wrong position. Although PTC systems vary widely in complexity and sophistication based on the level of automation and functionality they implement, the system architecture utilized and the degree of train control they are capable of assuming, PTC systems are consistent in that they are processor-based signal and train control systems (see Title 49 Code of Federal Regulations (CFR) Part 236, Subpart H) that utilize both computers and radio data links to accomplish PTC functions, e.g., monitoring and controlling train movements to provide increased safety.

More specifically, PTC requires that a train receives information about its location and where it is allowed to safely travel, i.e., "movement authorities." Equipment on board the train enforces these movement authorities thereby preventing unsafe movement. PTC systems often use Global Positioning System (GPS) navigation to track train movements or utilize other mechanism to calculate their track location. Thus, PTC is meant to provide train separation or collision avoidance, line speed enforcement, temporary speed restrictions and ensure rail worker wayside safety.

However, various other benefits may be achieved by use of PTC; for example, the information obtained and analyzed by PTC systems can enable on-board and off-board systems to control the train and constituent locomotives to increase fuel efficiency and to perform locomotive diagnostics for improved maintenance. Because the data utilized by the PTC system is transmitted wirelessly, other applications can use the data as well.

Early train protection systems were termed "train stops," which are still used by various metropolitan subway systems. In such implementations, beside every signal is a moveable clamp, which touches a valve on a passing train if the signal is red and opens the brake line, thereby applying the train's emergency brake; if the signal shows green, the clamp is turned away and does not impede operation of the train.

Other systems include the Integra-Signum system, wherein trains are influenced only at given locations, for instance whenever a train ignores a red signal, the emergency brakes are applied and the locomotive's motors are shut down. Additionally, such systems often require the operator to confirm distant signals (e.g., Continuous Automatic Warning System-CAWS) that show stop or caution; failure of a train operator to respond to the signal results in the train stopping. Such an implementation provides sufficient braking distance for trains following each other; however, such confirmation based systems do not always prevent accidents in stations where trains cross paths, because the distance from the red signal to the next obstacle may be too short for the train to brake to a stop.

More advanced systems, e.g. PZB or Indusi provide intermittent cab signaling and a train protection system that calculate a braking curve that determines if the train can stop before the next red signal, and brakes the train if the train cannot do so. One disadvantage to this approach is that acceleration of the train is prevented before the signal if the signal has switched to green. To overcome that problem, some systems, such as the Linienzugbeeinflussung, allow additional magnets to be placed between distant and home signals, or data transfer from the signaling system to the onboard computer is continuous.

Newer conventional PTC train protection systems use cab signaling, wherein the trains constantly receive information regarding their relative positions to other trains. In such systems, on-train computer processors run software that shows the train operator how fast he may drive, instead of him relying on exterior signals. Systems of this kind are in common use for high speed trains, where the speed of the trains makes it difficult if not impossible for the train operator to read exterior signals, and lengths of trains or distances between distant and home signals are too short for the train to brake.

SUMMARY

Disclosed embodiments provide a method in which signals of the train protection system are captured and analyzed by computer algorithms running on one or more computer processors in or accessible by an on-train, train control and operator assistance system to formulate commands and instructions for optimized train driving. As a result, trains controlled by an on-train, train control and operator assistance system designed in accordance with the disclosed embodiments do not violate any rules of the overarching train protection system.

BRIEF DESCRIPTION OF THE FIGURES

The detailed description particularly refers to the accompanying figures in which.

DETAILED DESCRIPTION

Disclosed embodiments provide a method for providing an optimized train driving strategy while conforming to the requirements of such train protection systems, including Positive Train Control (PTC) and "Automatic Train Protection" (ATP) systems. It should be understood that the presently disclosed embodiments may be used in conjunction with ATP systems and/or other PTC systems in use throughout the world. Therefore, any reference to either ATP or PTC system features is merely illustrative and not limiting to the utility of the presently disclosed embodiments.

Disclosed embodiments provide a method in which signals of an overarching train protection system are captured by equipment on board a train and analyzed by computer algorithms running on one or more computer processors provided on-board the train and included in an on-train, train control and operator assistance system (for example, commercially available systems marketed by New York Air Brake under the "LEADER" trademark). The train protection signals are analyzed and used to formulate commands and instructions for optimized train driving that are formulated and output by an on-train, train control and operator assistance system. As a result, trains controlled by the on-train, train control and operator assistance system designed in accordance with the disclosed embodiments do not violate any rules of the overarching train protection system.

Disclosed embodiments may be implemented to enhance safety by providing an optimized train driving strategy using wayside signaling while conforming to the requirements of an "Automatic Train Protection" (ATP) System. Thus, wayside signals are captured by the on-train, train control and operator assistance system.

Figure 1:
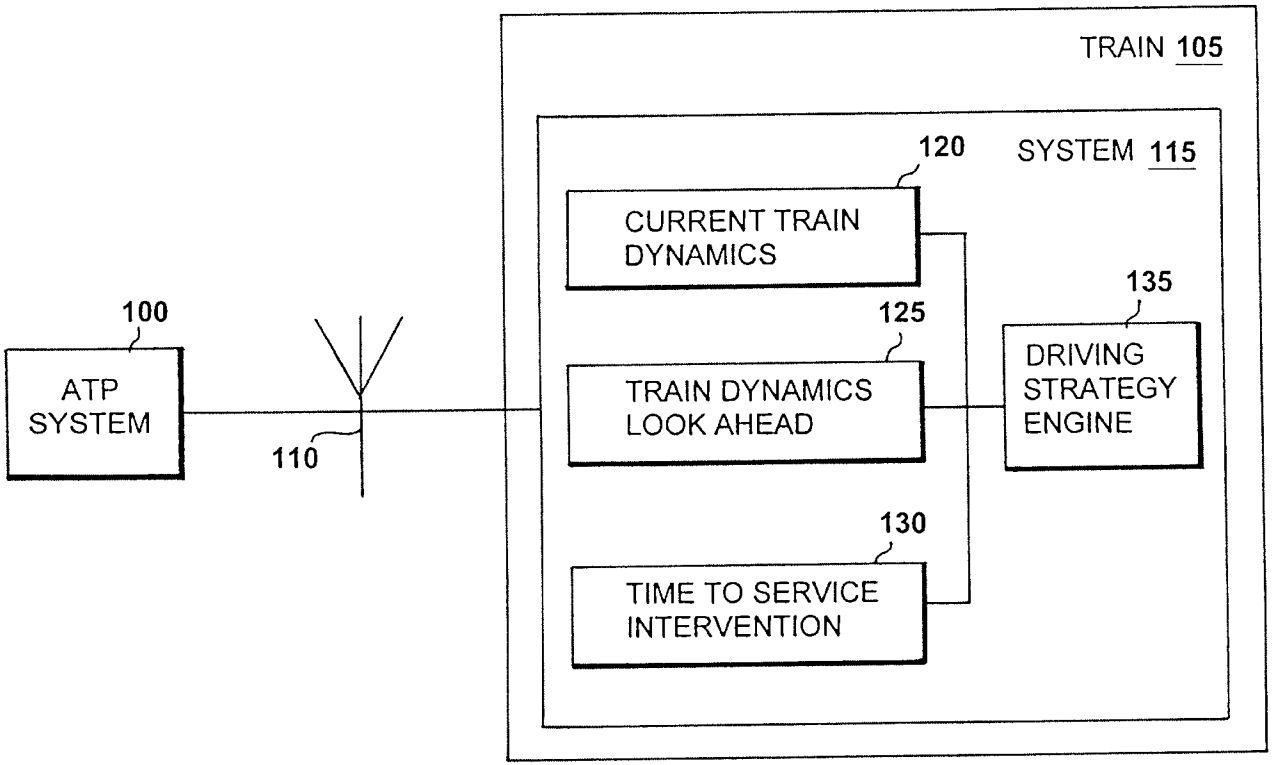
FIG. 1 is an illustration of a train system in which a wayside safety system, e.g., an Automatic Train Protection system, interacts with a train and its on-board intelligence.

Conventional wayside signalling systems used by overarching safety systems serve to control train speed and direct train routes through solid state wayside equipment, via lamp signalling However, various regulations have been put in place requiring wireless transmission of such signals to trains, via, for example, PTC. More specifically, using PTC, the antenna system 110 of FIG. 1, enables transmission and receipt of data from various pieces of conventional equipment, e.g., track circuits, lamps, etc., as a digital signal to the train 105, and more particularly, to one or more locomotives on the train 105 that are running the on-train, train control and operator assistance system 115 provided with the functionality of the presently disclosed embodiments.

Accordingly, the disclosed embodiments provide an on-train, train control and operator assistance system that is aware of the data, warnings and direction from the wayside safety system even though that information may also be provided visually to the train operator.

If the operator fails to take an action suggested, indicated or required by the overarching safety system, the on-train, train control and operator assistance system can enforce the action to ensure safety. Additionally, by enabling the on-train, train control and operator assistance system to have access to the information indicating data, warnings and direction from the wayside safety system, the on-train, train control and operator assistance system can take this data into account when providing optimized train driving direction.

Disclosed embodiments provide a method for enabling optimized train driving strategy while staying under the safety umbrella of the ATP System or the like. In order to do this, the signals of the ATP System are captured by the on-train, train control and operator assistance system and taken into consideration by algorithms running on the on-train, train control and operator assistance system that control or provide recommendations or guidance to train operators such that the train does not violate any rules of the overarching safety system, while recommending or implementing an optimized driving strategy to reduce fuel consumption, improve safety, etc.

In order to operate effectively, the system needs to avoid triggering interventions from the ATP system. The ATP system effectively tracks the location of a train and makes sure that the train does not pass its Limit of Authority (LOA), which is the farthest location on the current route that the train is authorized to approach. In addition, the ATP system also verifies that the train does not exceed any speed limits throughout the track network. If the train exceeds the thresholds of the ATP system, the ATP system may trigger either a penalty brake application to slow the train or an emergency intervention depending on the circumstances.

Disclosed embodiments provide at least two methodologies that accomplish this feature.

In a first disclosed embodiment methodology, a "time to service intervention" signal is provided by the train protection system, e.g., PTC or ATP system. This signal, along with other types of signals is transmitted from a wayside signal antenna (included in the antenna signaling system 110) located next to the track upon which the train travels. This transmission is received by an antenna on the train (included in the antenna signaling system 110) and analyzed by the on-train, train control and operator assistance system 115 to determine an optimized train driving strategy. More specifically, the optimized train driving strategy is generated by the driving strategy engine 135 based on various data including, for example, current train dynamics 120, train dynamic look ahead data 125 and the time to service intervention data included in the transmitted signal sent from the safety system (e.g., ATP, PTC or the like) 100.

The time to service intervention signal is a measure of the time, at the current train speed, from which the on-train, train control and operator assistance system would apply an intervention or penalty brake to alter operation of the train.

Figure 2:
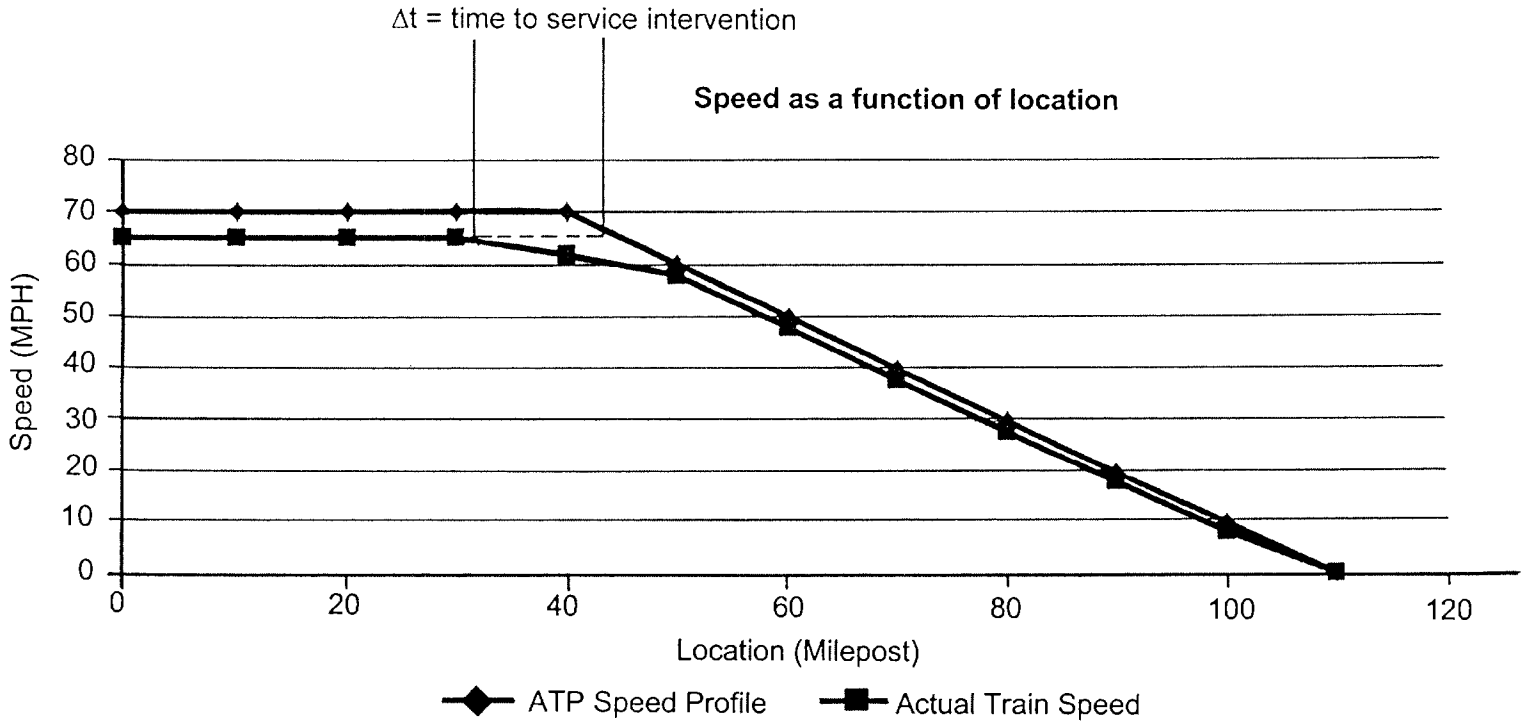
FIG. 2 illustrates a speed profile of a safety system and the subsequent actual train speed profile wherein the time to service intervention signal is utilized in accordance with the disclosed embodiments.

FIG. 2 illustrates a speed profile of a safety system (e.g., ATP Speed Profile) and the subsequent actual train speed profile (Actual Train Speed). The time to service intervention signal includes the time to service intervention calculated as the difference in time (At) before the actual train speed profile violates the safety system speed profile.

Figure 3:
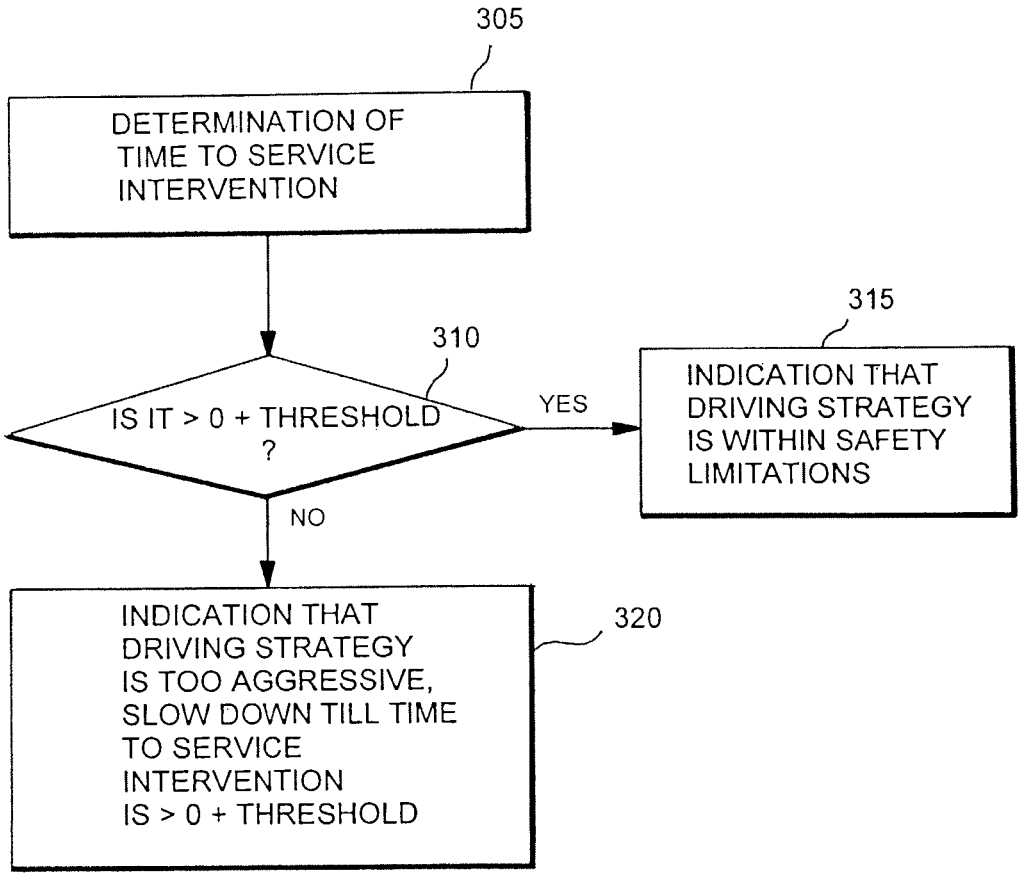
FIG. 3 illustrates operations performed to determine whether a current driving strategy is within safety limitations based on the data provided by the time to service intervention signal.

FIG. 3 illustrates operations performed to determine whether a current driving strategy is within safety limitations based on the data provided by the time to service intervention signal. As shown in FIG. 3, at 305, a determination is made as to the time to service intervention based on the transmitted signal from the safety system to the on-train, train control and operator assistance system; in implementation this determination may be based solely on the data received in the time to service intervention signal received from the wayside safety system.

At 310, it is determined whether the time to service intervention is greater than zero plus a threshold value. That threshold value is a configurable parameter and is measured in seconds; by enabling the value to configurable, the train or ATP system operator is able to effect the level of security in avoiding a service intervention that it desires, i.e., setting a smaller number allows greater risk in driving strategy because it provides less of a "buffer" in the analysis. That is, given that the goal is to avoid ATP service intervention, by increasing the buffer between acceptable strategy and the point of service intervention, one theoretically reduces the risk of that intervention. In the same way, decreasing the buffer or threshold value enables the system to operate more aggressively and provide strategies that are closer to the point that a service intervention is triggered.

If the comparison indicates that the time to service intervention is greater than the threshold, than a determination is made that the driving strategy is within safety limitations. Accordingly, an indication of this is output at 315. However, if the comparison indicates that the time of service intervention is less than the threshold, than a determination is made that the driving strategy is not within safety limitations. Accordingly, an indication of this is output at 320. These indications may be implemented as simply as data output to software algorithms running on the on-train, train control and operator assistance system and serve as a double check or confirmation that a presently used driving strategy is optimized to avoid wayside safety system service intervention. Alternatively, the data may be used in other applications and/or output to the train operator or transmitted to the overarching safety system in some manner to ensure or indicate consideration of or compliance with, the requirements of the system.

Figure 4:
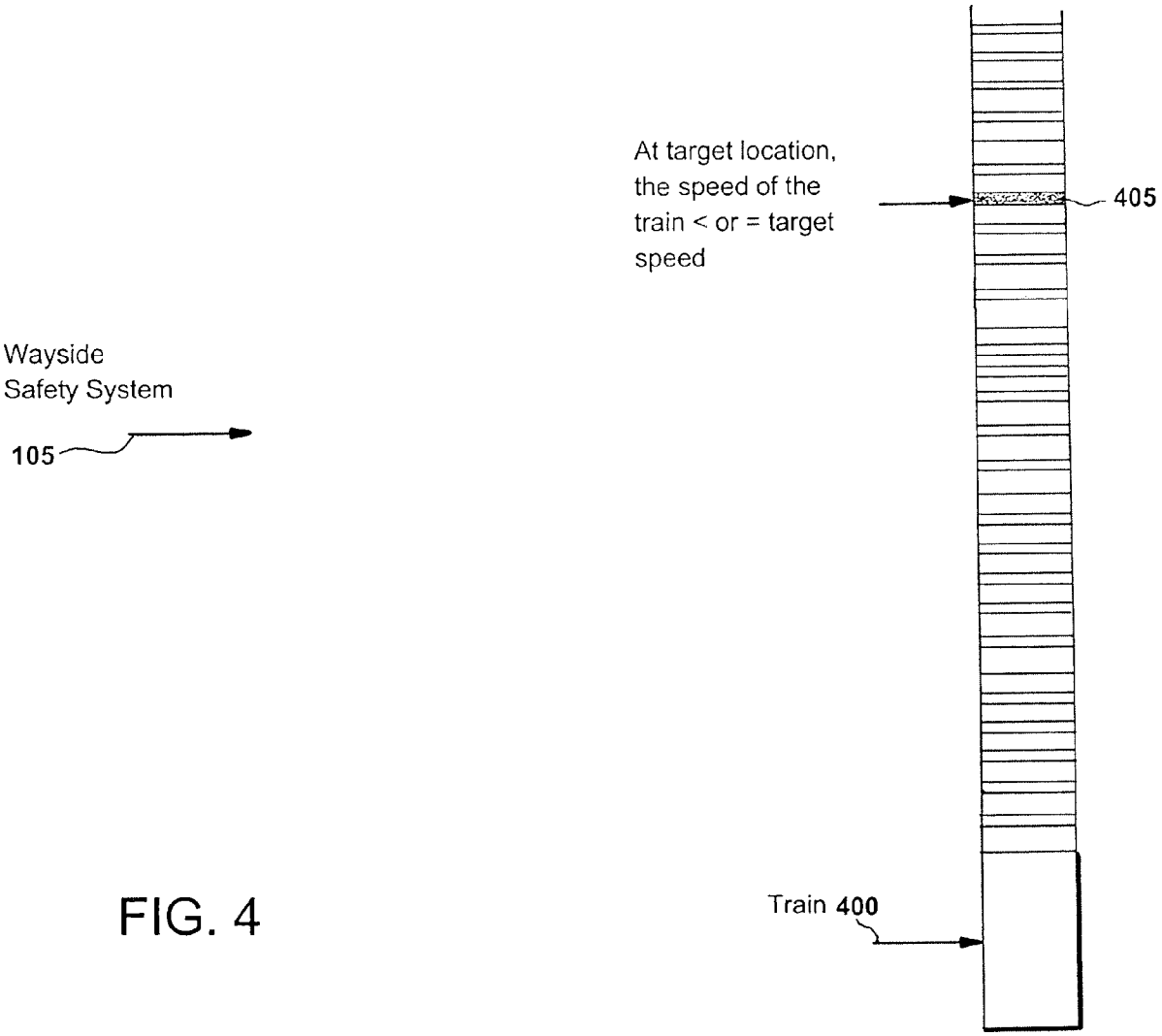
FIG. 4 illustrates how a speed target position and a subsequent target speed are utilized when deter mining an appropriate driving strategy in accordance with disclosed embodiments.

In a second disclosed embodiment methodology, a speed target position and a subsequent target speed are defined and utilized. More specifically, as illustrated in FIG. 4, the wayside safety system transmits a target speed and a target speed location 405 to the train 400 using the antenna system 110; thus, an antenna for the wayside safety system transmits this data to an antenna included in or coupled to the on-train, train control and operator assistance system on the train. The on-train, train control and operator assistance system utilizes the transmitted speed value as a maximum permitted speed at the target location 405, i.e., the speed target position. The on-train, train control and operator assistance system utilizes "Look Ahead" functionality to make a future prediction regarding various parameters, including speed, of the train at the target position. The on-train, train control and operator assistance system also determines various other trains dynamics including acceleration, braking forces, and in-train forces given the current train control setting (i.e. throttle, dynamic brake, and airbrake settings) and their subsequent comparisons to the track thresholds (i.e. speed restriction limits and driving thresholds of the safety system). In this way, the on-train, train control and operator assistance system is able to further ensure that the presently implemented train driving strategy is within specified safety limitations.

Figure 5:
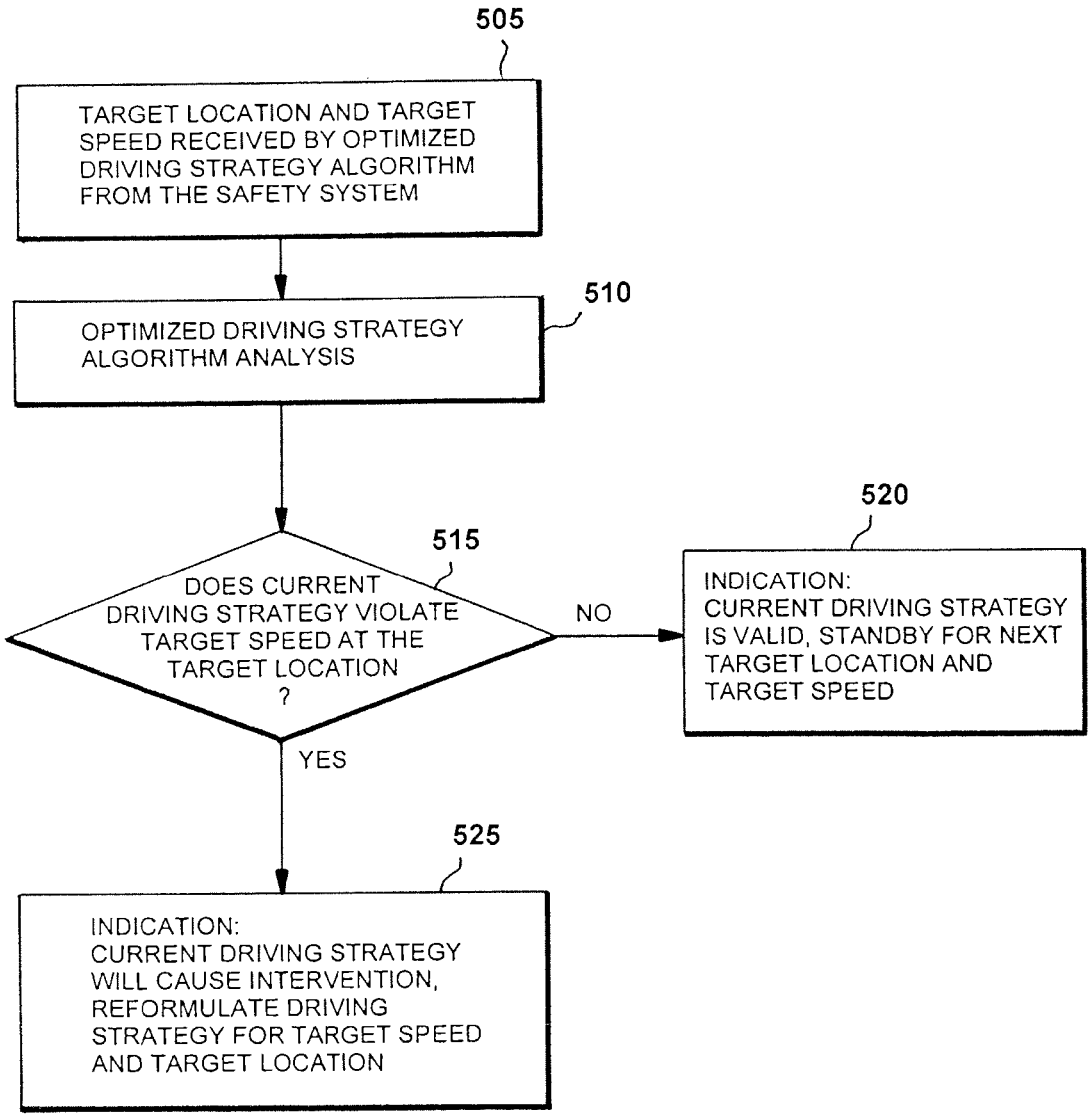
FIG. 5 illustrates this concept as to how to use the target position and speed to provide appropriate driving strategy.

FIG. 5 illustrates this concept as to how to use the target position and speed to provide appropriate driving strategy. As shown in FIG. 5, the target location and target speed at that location are received by the optimized driving strategy algorithm (part of the on-line, train control and operator system) from the safety system 505. This is received via the antenna system. The optimized driving strategy algorithm then analyzes the data and uses it as a maximum allowable speed for reference by the Look Ahead functionality at 510. As a result, a determination is made at 515, whether the current driving strategy violates the target speed at the target location.

If it does not, than a determination is made that the driving strategy is within safety limitations. Accordingly, an indication of this is output at 520. However, if the comparison indicates that the maximum speed will be exceeded by the current driving strategy, than a determination is made that the driving strategy is not within safety limitations. Accordingly, an indication of this is output at 525. These indications may be implemented as simply as data output to software algorithms running on the on-train, train control and operator assistance system and serve as a double check or confirmation that a presently used driving strategy is optimized to avoid wayside safety system service intervention. Alternatively, the data may be used in other applications and/or output to the train operator or transmitted to the overarching safety system in some manner to ensure or indicate consideration of, or compliance with, the requirements of the system.

Disclosed embodiments may be implemented in conjunction with various on-train, train control and operator assistance systems and components thereof. Thus, it should be understood that disclosed embodiments may be incorporated in or be coupled to on-train, train control and operator assistance system components including, for example, a PTC system module that may include hardware, software, firmware or some combination thereof that provide a speed display, a speed control unit on at least one locomotive of the train, a component that dynamically informs the speed control unit of changing track or signal conditions, an on board navigation system and track profile database utilized to enforce fixed speed limits along a train route, a bi-directional data communication link configured to inform signaling equipment of the train's presence so as to communicate with centralized PTC systems that are configured to directly issue movement authorities to trains.

Figure 6:
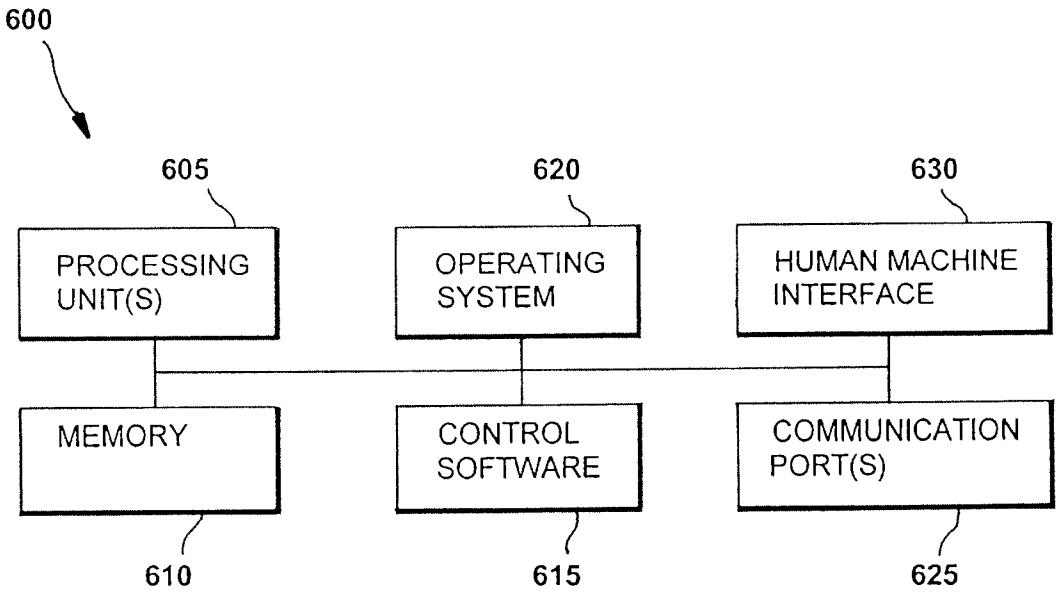
FIG. 6 illustrates an example of equipment that may be used to provide the disclosed embodiments.

Thus, the above-identified functionality may be implemented in various combinations of the above-identified hardware, software and firmware. Accordingly, to perform these types of operations, the train intelligence provided to perform these operations may include (but is not limited to) the equipment illustrated in FIG. 6. As shown in that figure, the train intelligence 600 may be included on the train 105 (shown in FIG. 1). Regardless of the implementation, the train intelligence 600 may include one or more computer processing units 605 that may be coupled to memory 610 (implemented as one or more conventionally known and commercially available programmable and/or read only or reprogrammable memory devices). The memory 610 may serve to store computer instructions associated with or implementing both control software 615 and optionally an operating system or environment 620 for performing operations included in one or more computer applications, software code packages and/or various called or included subroutines. These instructions may be used to perform the instructions included in the methodologies and determinations described above.

Moreover, the train intelligence may also include one or more communication ports 625 that enable both receipt and transmission of messaging and signaling (such as the signaling received from the wayside transponders), data and control instructions in accordance with the disclosed embodiments. Furthermore, the train intelligence 600 may include a human machine interface 630 that may include, for example, a display that enables an operator to receive and review data utilized or produced by the train intelligence 600, provide instruction or input direction to the control software 615, access data included in the memory 610, etc. As a result, the human machine interface 630 may also include other conventionally known features including a keyboard, a mouse, a touch pad, various buttons and switches, etc.

The invention claimed is:

1. A train navigation system, comprising:

a train control system for positioning onboard a train and establishing a driving strategy of the train, wherein the train control system includes a processor and an antenna coupled to the processor for receiving a train protection signal comprising a time to service intervention from a wayside transponder;

wherein the processor is programmed to determine whether the driving strategy of the train is consistent with the train protection signal when received by the antenna from the wayside transponder.

2. The train navigation system of claim 1, wherein, if the processor determines that the driving strategy of the train is not consistent with train protection signal received from a wayside transponder, the processor is further programmed to trigger.

3. The train navigation system of claim 1, wherein the time to service intervention signal is a measure of the time, at a current train speed, from which the train control system would have to apply an intervention or penalty brake to alter operation of the train.

4. The train navigation system of claim 1, wherein the processor is programmed to determine whether the time to service intervention is greater than zero plus a predetermined threshold value in seconds.

5. The train navigation system of claim 1, wherein the processor determines the location of the train using Global Positions System data.

6. The train navigation system of claim 1, further comprising a user interface coupled to the processor, wherein the processor is programmed to formulate and output driving advice to a train operator of the train via the user interface.

7. A train navigation system, comprising:

a train control system for positioning onboard a train and establishing a driving strategy of the train, wherein the train control system includes a processor and an antenna coupled to the processor for receiving a train protection signal comprising a target speed and a target speed location from a wayside transponder;

wherein the processor is programmed to determine whether the driving strategy of the train is consistent with the train protection signal when received by the antenna from the wayside transponder.

8. The train navigation of claim 7, wherein the processor is programmed to calculate a future prediction of the speed of the train at the target location based on the driving strategy and to determine whether the future prediction exceeds the target speed at the target speed location.

9. A train navigation system, comprising:

a train control system for positioning onboard a train and establishing a driving strategy of the train, wherein the train control system includes a processor, an antenna coupled to the processor for receiving a train protection signal from a wayside transponder, and a user interface coupled to the processor;

wherein the processor is programmed to formulate and output driving advice to a train operator of the train via the user interface and to determine whether the driving strategy of the train is consistent with the train protection signal when received by the antenna from the wayside transponder, wherein the driving advice takes into consideration the speed restrictions for upcoming track segments along a current track profile.

10. A method of controlling a train, comprising the steps of:

providing a train control system for positioning onboard a train and establishing a driving strategy of the train, wherein the train control system includes a processor, and an antenna coupled to the processor for receiving a signal including train protection signal from a wayside transponder, wherein the processor is programmed to determine whether the driving strategy of the train is consistent with any train protection signal received from the wayside transponder, wherein the train protection signal comprises a time to service intervention that is analyzed by the processor along with current train dynamics and train dynamic look ahead data to determine an optimized driving strategy;

receiving the signal including train protection signal from the wayside transponder;

determining whether the driving strategy of the train complies with the train protection signal received from the wayside transponder; and causing a change in the driving strategy of the train if the driving strategy of the train does not comply with the train protection signal received from the wayside transponder so that a service interruption is not triggered under rules of the train protection system.

11. The method of claim 10, wherein, if the driving strategy of the train does not comply with the train protection signal, the processor is programmed to trigger either a penalty brake application to slow the train or an emergency intervention.

12. The method of claim 10, wherein the time to service intervention is a measure of the time, at a current train speed, from which the train control system would have to apply an intervention or penalty brake to alter operation of the train.

13. The method of claim 10, wherein the processor is programmed to determine whether the time to service intervention is greater than zero plus a predetermined threshold value in seconds.

14. The method of claim 10, wherein the train protection signal comprises a target speed and a target speed location data.

15. The method of claim 14, wherein the processor is programmed to calculate a future prediction of the speed of the train at the target location based on the driving strategy and to determine whether the future prediction exceeds the target speed at the target speed location.

* * * * *